US009052066B2

(12) United States Patent
Ter-Hovhanissian

(10) Patent No.: US 9,052,066 B2
(45) Date of Patent: Jun. 9, 2015

(54) LED LIGHT BULB WITH INTEGRATED HEAT SINK

(75) Inventor: Artak Ter-Hovhanissian, Glendale, CA (US)

(73) Assignee: The Artak Ter-Hovhanissian Patent Trust, North Hollywood, CA (US)

( * ) Notice: Subject to any disclaimer, the term of this patent is extended or adjusted under 35 U.S.C. 154(b) by 726 days.

(21) Appl. No.: 13/249,657

(22) Filed: Sep. 30, 2011

(65) Prior Publication Data

US 2013/0082600 A1 Apr. 4, 2013

(51) Int. Cl.

| | |
|---|---|
| ***F21V 15/00*** | (2006.01) |
| ***F21K 99/00*** | (2010.01) |
| *F21V 23/00* | (2006.01) |

(52) U.S. Cl.

CPC ..... *F21K 9/13* (2013.01); *F21V 23/007* (2013.01); *F21V 29/70* (2015.01)

(58) Field of Classification Search

USPC ..... 315/46, 49, 50, 185 S, 105, 107; 362/362, 364, 382, 227, 249

See application file for complete search history.

(56) References Cited

U.S. PATENT DOCUMENTS

| | | | | |
|---|---|---|---|---|
| 7,676,915 | B2 | 3/2010 | Ter-Hovhannissian | |
| 8,334,644 | B2 * | 12/2012 | Ramer et al. | 313/498 |
| 2009/0315442 | A1 * | 12/2009 | Rooymans | 313/46 |
| 2010/0008086 | A1 * | 1/2010 | Broitzman | 362/231 |
| 2010/0240158 | A1 | 9/2010 | Ter-Hovhannissian | |
| 2011/0156565 | A1 * | 6/2011 | Chin | 313/46 |
| 2012/0074843 | A1 * | 3/2012 | Recker et al. | 315/86 |
| 2013/0308310 | A1 * | 11/2013 | Wilk | 362/235 |
| 2014/0063837 | A1 * | 3/2014 | Rowlette, Jr. | 362/555 |

* cited by examiner

*Primary Examiner* — Tuyet Vo

(74) *Attorney, Agent, or Firm* — Kelly & Kelley, LLP

(57) ABSTRACT

An LED lamp includes a lamp housing including an aluminum alloy substantially free of silicone. An electrical circuit trace is disposed on the lamp housing. An LED is attached directly to the lamp housing and electrically connected to the electrical circuit trace. LED driver circuitry is electrically connected to the electrical circuit trace. A housing contains the LED driver circuitry. A threaded incandescent light-type electrical plug may be configured for reception into a standard incandescent light-type socket. The LED driver circuitry is electrically disposed between the electrical plug and the LED. The lamp housing may include a generally frusto-conical shape. A solder mask may be affixed over at least a portion of the electrical circuit trace. The lamp housing may be press formed. The lamp housing is in direct thermal conductive relation to the LED such that heat energy is dissipated from the LED directly to the lamp housing.

25 Claims, 5 Drawing Sheets

LED LIGHT BULB WITH INTEGRATED HEAT SINK

FIELD OF THE INVENTION

The present invention generally relates to light emitting diodes (LEDs). More particularly, the present invention relates to an LED light bulb with an integrated heat sink.

BACKGROUND OF THE INVENTION

Light emitting diodes (LEDs) have been available since the early 1960s in various forms, and are now widely applied in a variety of ways, including signs and message boards, vehicle lights, and even interior lights. The relatively high efficiency of LEDs is the primary reason for their popularity. Tremendous power savings are possible when LEDs are used to replace traditional incandescent lamps of similar luminous output.

One aspect of high powered LED technology that has not been satisfactorily resolved is the removal of heat generated by the LED. LED lamps exhibit a substantial light output sensitivity to temperature, and in fact are permanently degraded by excessive temperature. Recently, very high performance LEDs have been commercialized. However, these LEDs emit a substantial amount of heat during their operation, which can permanently degrade the LED over time, resulting in a lower output and operating life. In ideal conditions, the life of the LED is 50,000-100,000 hours, however, this life can be shortened to less than 10% of the designed life due to the heat generated by these new super bright LEDs. Until recently, the higher light output was the trade-off for the shortened life due to the heat it generated.

To maximize the life of LEDs a heat sink coupled to the LEDs has been increasingly used. For example, aluminum or metal core printed circuit boards (PCB) have been used. These PCBs have a dielectric layer on top of the metal surface which acts as an electrical insulator between the circuitry and the metal base. The circuit traces are then formed on top of the dielectric, and the electronic components attached thereto. There are several ways to manufacture a metal core PCB. For example, thin FR4 or fiberglass circuit board that already has the circuitry printed onto it is mounted onto a metal substrate. Another method is to print the circuitry onto the dielectric material after it has already been mounted onto the metal substrate.

Due to the rise in popularity of LEDs, they are now widely used in architectural lamps and are becoming the standard in energy saving lighting applications. There are currently 500 million recessed lamps in America today and most of them have to be replaced with more efficient and eco-friendly lamps within few years. Light fixture designers and engineers are always challenged by the fact that a massive heat-sink is required to remove the heat from the LED, which is crucial to the life and the performance of the LED.

Currently designers use a die-cast aluminum alloy conical shape body/housing as the heat-sink. The LEDs are assembled on a metal core PCB and then mounted on the heat-sink with thermal conductive paste. The LED driver is then placed in a plastic housing which also houses the lamp socket and the whole assembly is attached to the aluminum alloy heat-sink.

However, there are several key problems with these designs. The first problem is that the aluminum alloys generally used to die cast these parts have silicone mixture in them for flow characteristics and smooth finish. Silicone causes the die cast alloy mixture to have a very low thermal conductivity ranging from 96.2 to 121 W/m-K. The thermal conductivity of non die cast aluminum alloy, which don't contain silicone in the mixture, such as extruded or rolled aluminum alloy is much higher, 167 W/m-K. This is 57% higher thermal conductivity which means that these aluminum alloys would dissipate the heat more than twice as fast compared to a die cast aluminum alloy. The second problem is that die-cast parts are expensive and consume way too much energy to produce them. They also break easily because of the silicone mixture. Another problem associated with the current designs is that the metal core PCB which has an aluminum core and it is covered with either a ceramic or polymer material as the dielectric. The dielectric material acts as a barrier for the heat to dissipate from the LEDs. Although many methods are used to make the heat dissipation better, but the fact remains that it is still an existing problem.

Another problem exists in the life expectancy between the LEDs themselves and the components used to operate them. A typical light socket is running on alternating current (AC) power, whereas an LED requires direct current (DC). An AC to DC converter (or also called a driver) is used to convert the AC power to DC power. The LED driver is inside the lamp assembly. The drivers must have an isolated transformer inside the driver unit to isolate the AC from DC to protect the consumers from getting electrical shocks. These drivers also have capacitors and other electronic components that have relatively shorter life than the LEDs. The drivers have a 5 year life in general, whereas the LED cluster would last more than 100,000 hours or over 12 years. Also, the LED cluster is usually the most expensive part of the lamp. So when the driver fails, the whole lamp must be discarded.

In summary the recessed lamps today that use die-cast heat-sink are expensive, have poor thermal conductivity, are heavy, require expensive tooling and use metal core PCBs that act as thermal barriers which slows heat dissipation. Also, when the LED driver fails, the whole light along with a functioning LED cluster must be discarded. Accordingly, there is a need for a LED light bulb with integrated heat sink and also a separable LED driver and cluster assembly that overcomes these drawbacks. The present invention fulfills these needs and provides other related advantages.

SUMMARY OF THE INVENTION

The LED lamp of the present invention includes a lamp housing and an electrical circuit trace disposed on the lamp housing. An LED is attached directly to the lamp housing and electrically connected to the electrical circuit trace. The lamp housing is in direct thermal conductive relation to the LED such that heat energy is dissipated from the LED directly to the lamp housing.

LED driver circuitry may be electrically connected to the electrical circuit trace. A housing may contain the LED driver circuitry. A threaded incandescent light-type electrical plug may be configured for reception into a standard incandescent light-type socket. The LED driver circuitry may be electrically disposed between the electrical plug and the LED.

The lamp housing may include an aluminum alloy. The aluminum alloy may be substantially free of silicone. The lamp housing may include a generally frusto-conical shape. The lamp housing may be press formed. A solder mask may be affixed over at least a portion of the electrical circuit trace.

Exemplary embodiments may include a first half of an electrical connector attached relative to the lamp housing and electrically connected to the LED. A second half of the electrical connector may be attached relative to and electrically connected to the LED driver circuitry. The first and second halves of the electrical connector are removably connected, such that various old or broken parts may be replaced with new parts.

Exemplary embodiments may also include a light lens cap attached relative to the lamp housing. A lens may be disposed between the light lens cap and lamp housing. The lens may include a phosphor coating. A diffuser may be disposed within the lamp housing. The LED driver circuitry may be disposed directly on the lamp housing.

In another exemplary embodiment of the present invention, an LED lamp includes a lamp housing including an aluminum alloy substantially free of silicone. An electrical circuit trace is disposed on the lamp housing. An LED is attached directly to the lamp housing and electrically connected to the electrical circuit trace. LED driver circuitry is electrically connected to the electrical circuit trace. A housing contains the LED driver circuitry. The lamp housing is in direct thermal conductive relation to the LED such that heat energy is dissipated from the LED directly to the lamp housing.

A threaded incandescent light-type electrical plug may be configured for reception into a standard incandescent light-type socket. The LED driver circuitry is electrically disposed between the electrical plug and the LED. The lamp housing may include a generally frusto-conical shape. A solder mask may be affixed over at least a portion of the electrical circuit trace. The lamp housing may be press formed.

Exemplary embodiments may include a first half of an electrical connector attached relative to the lamp housing and electrically connected to the LED. A second half of the electrical connector may be attached relative to and electrically connected to the LED driver circuitry. The first and second halves of the electrical connector may be removably connected.

Exemplary embodiments may also include a light lens cap attached relative to the lamp housing. A lens may be disposed between the light lens cap and lamp housing. The lens may include a phosphor coating. A diffuser may be disposed within the lamp housing. The LED driver circuitry may be disposed directly on the lamp housing.

In another exemplary embodiment of the present invention, a method for manufacturing an LED lamp assembly includes the steps of cutting a flat substrate into a first shape, forming electrical circuit traces on the flat substrate to establish discrete and electrically conductive paths for electrically interconnecting electronic components, the circuit traces including at least one LED landing, electrically and mechanically attaching an LED to the at least one LED landing, and press forming the flat substrate into a second shape. The flat substrate may include aluminum alloy which is substantially free of silicone.

The first shape may include a generally circular shape. The second shape includes a generally conical or frusto-conical shape. The second shape includes a flat section connected to a non-planar press formed section, where the electrical circuit traces and LED are disposed along the flat section.

The method may include the step of curing the electrical circuit traces. The method may include the step of applying a solder mask over at least a portion of the flat substrate and electrical circuit trace.

The method may include the step of attaching a lens to one end of the second shape of the press formed substrate. The method may include the step of attaching a housing for the LED driver circuitry to an opposite end of the second shape of the press formed substrate.

The method may include the step of attaching a threaded incandescent light-type electrical plug configured for reception into a standard incandescent light-type socket to a free end of the housing. The method may include the step of attaching an LED driver circuitry within the driver housing in electrical communication with the electrical plug and LED.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

This disclosure fully incorporates herein the teachings of U.S. Pat. No. 7,676,915 issued on Mar. 16, 2010.

Figure 1:
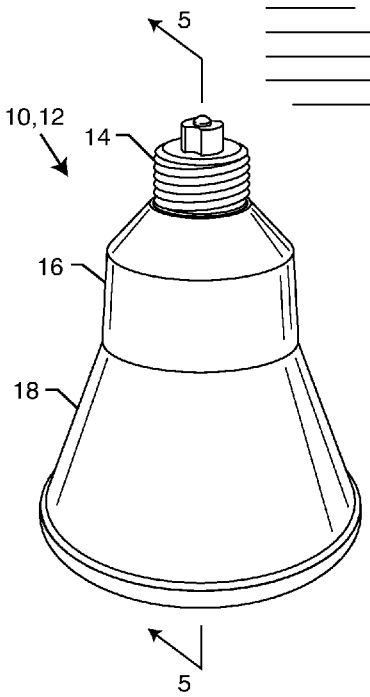
FIG. 1 is a perspective view of an exemplary recessed lamp embodying the present invention.

As shown in the drawings for purposes of illustration, the present invention for an LED light bulb with integrated heat sink is referred to generally by the reference number 10. FIG. 1 is a perspective view of an exemplary recessed lamp 12 embodying the present invention. The recessed lamp 12 has a threaded lamp/light bulb cap 14 to attach the device to existing light sockets used today. The cap 14 is connected to a driver housing 16. (It is known to those skilled in the art that the cap 14 comprises a threaded metallic outside which screws into a standard electrical light bulb socket. At the bottom of the cap 14 is an electrical contact separated by an insulator from the metallic threaded outside.) The driver housing 16 is typically plastic, but can be any other suitable material such as metal, carbon fiber, composites and the like. The conical-shaped lamp housing 18 is shown connected to the driver housing 16.

Figure 2:
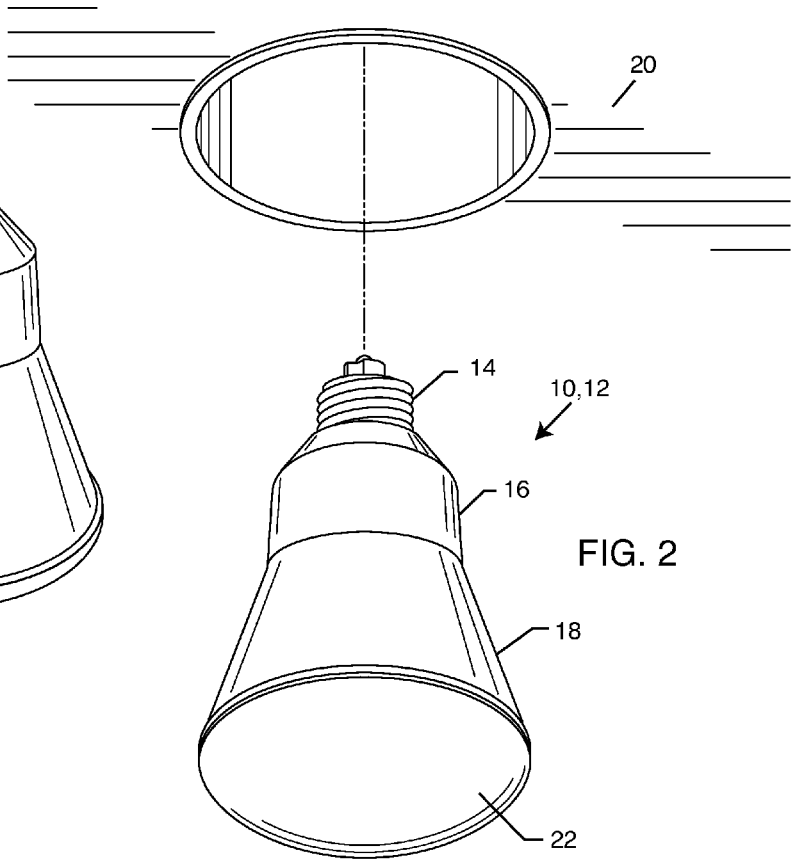
FIG. 2 is a perspective view of the structure of FIG. 1 being mounted into a ceiling.
Figure 3:
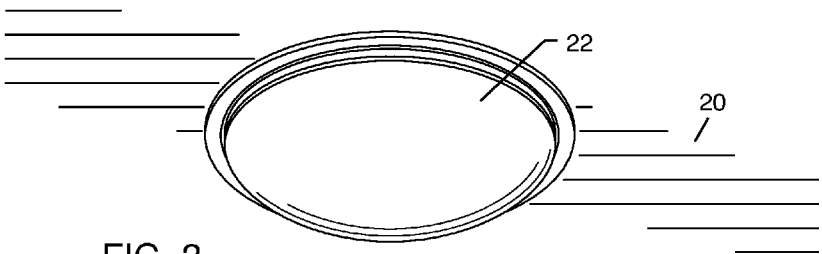
FIG. 3 is a perspective view of the structure of FIG. 1 already mounted into a ceiling.

FIG. 2 is a perspective view of the structure of FIG. 1 being mounted into a ceiling 20. FIG. 3 is a perspective view of the structure of FIG. 1 already mounted into a ceiling 20. A plastic lens 22 protects the internal parts of the recessed lamp 12.

Figure 4:
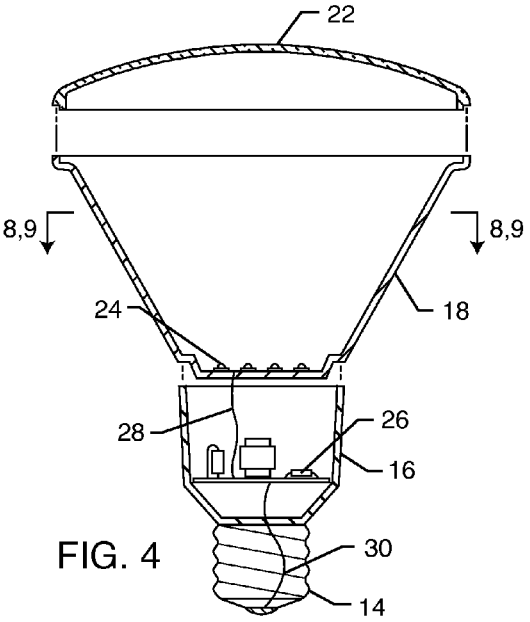
FIG. 4 is an exploded sectional view of an embodiment of the structure of FIG. 1.
Figure 5:
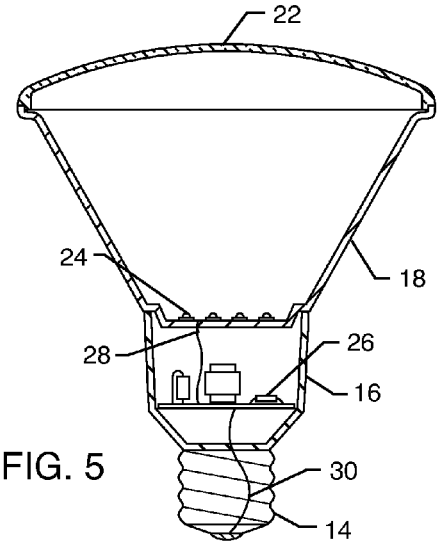
FIG. 5 is an assembled view of the structure of FIG. 4.
Figure 6:
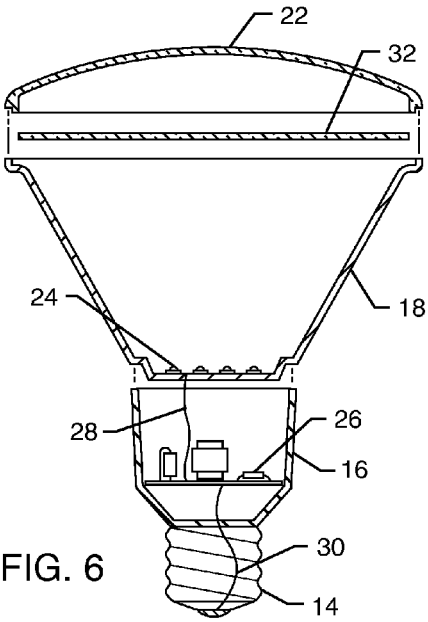
FIG. 6 is an exploded sectional view of another embodiment of the structure of FIG. 1.
Figure 7:
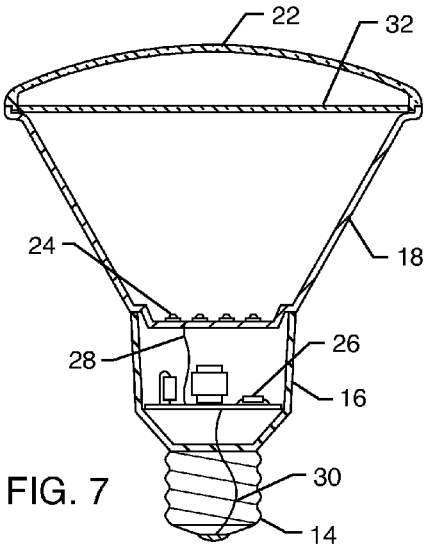
FIG. 7 is an assembled view of the structure of FIG. 6.

FIG. 4 is an exploded sectional view of an embodiment of the structure of FIG. 1 and FIG. 5 is an assembled view of the structure of FIG. 4. The plastic lens 22 (light lens cap) is connected to the conical-shaped lamp housing 18. Inside the lamp housing 18 are the LEDs 24. Connected to the driver housing 16 is the LED driver circuitry 26. There is an electrical connection 28 from the LED driver circuitry 26 to the cluster of LEDs 24. There is another electrical connection 30 between the LED driver circuitry 26 and the cap 14. FIGS. 6 and 7 are similar to FIGS. 4 and 5 but now have the addition of an intermediate lens 32 that now may be made from glass or plastic and may also include a phosphor coating.

In these embodiments of the present invention, the lamp housing/body 18 is also a heat sink. Accordingly, the present invention discloses an integrated heat-sink lamp housing 18 or ILB (integrated lamp body) 18. A new and improved method of manufacturing the device 10 is disclosed where the ILB 18 is made from a flat sheet of aluminum alloy with the LEDs 24 mounted directly in the center of the sheet. Then the ILB 18 is shaped into a conical shape using a press. A special press is used such that it forms the flat sheet of aluminum alloy into the conical-shape without exerting forces or stress onto the LEDs 24. This way the LEDs can be placed upon a flat sheet of aluminum alloy using standard techniques and devices, and then the conical shape be formed thereafter. The cone-shaped ILB 18 could be shaped into different sized conical shapes depending on various factors to create a plurality of different sized and shaped lamps 12. Then the LED driver circuitry 26 along with the cap 14 is then mounted to the bottom of the conical shaped lamp housing 18 from the back and the lens 22 is mounted to the wide section of the conical-shaped lamp housing 18.

An exemplary embodiment is hereafter discussed in more detail. For example, to build a PAR 30 lamp with an ILB 18, a flat sheet of anodized aluminum alloy with typical 1 to 1.5 mm thickness material would be used. The specific thickness of the flat sheet is not critical, but due to the bending and shaping from the press, it is preferred to use a thickness that would be easy to work with. A circular shape of about 8-9" inches in diameter is cut from the flat sheet. Specifically located and sized holes could also be punched on the surface of the flat sheet so that after forming the ILB 18, the lamp socket assembly 16 along with the LED driver circuitry 26 could be mounted to it. It is also necessary to have input wire access hole on the bottom of the ILB 18. Conductive electrical circuit traces for the LEDs 24 are then screened, sputtered or formed onto the center of the circular sheet which forms approximately a 2 inch circle. After curing the electrical traces a solder mask is applied using traditional methods and the LEDs 24 are mounted in the center of the flat sheet. Using a specially designed tooling for press forming, the flat sheet of alloy is then pressed into a desired conical shape which becomes the lamp body or ILB 18.

The cross section shapes of the ILB 18 are important to add airflow and convection for better heat dissipation. The inside surface of the ILB 18 could also be used as a circuit board and other electronic components could be mounted. This might be useful for higher wattage lamps 12 to remove the high temperature components from the driver 26 and place them inside the ILB 18 where there is better heat dissipation.

There are many advantages achievable through the teaching of this disclosure. First, the recessed lamps 12 are much easier and cheaper to make. The present invention requires no metal core or any PCB, because the ILB 18 is the PCB. Also, the thermal dissipation of stock aluminum alloy is 57% better than die-cast parts. This means that the LEDs 24 will last significantly longer than current designs. Additionally, the present invention results in a lighter lamp 12 by a factor of 5. This therefore means lower shipping costs. Furthermore, expensive tooling is not required and very little energy is required to press form the ILB 18. In various embodiments, the parts may be made to snap together through snap connections and appropriately sized and shaped features. For instance, the lens 22 can be snapped onto the lamp housing 18 at the wide end and then the driver housing 16 can be snapped onto the lamp housing 18 at the small end. The cap 14 can then snap onto the driver housing 16.

Figure 8:
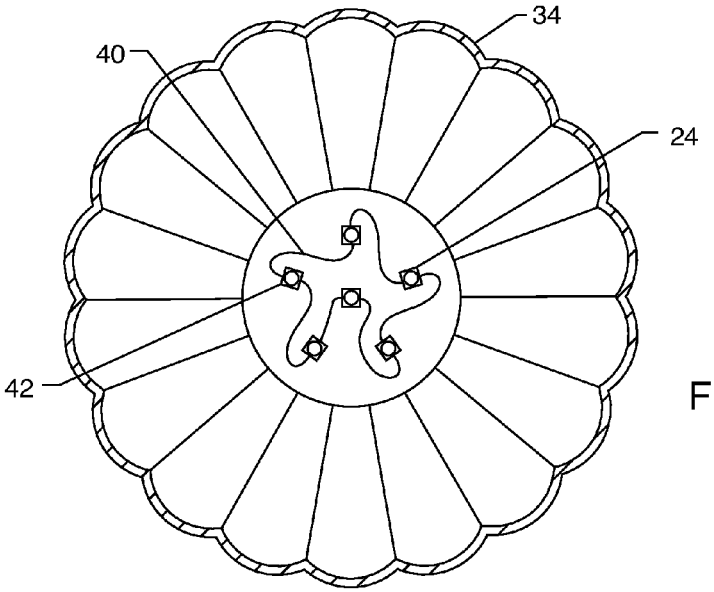
FIG. 8 is a top view of an embodiment of surface interruptions on the inside surface of a conical-shaped housing taken along line 8-8 of FIG. 4.
Figure 9:
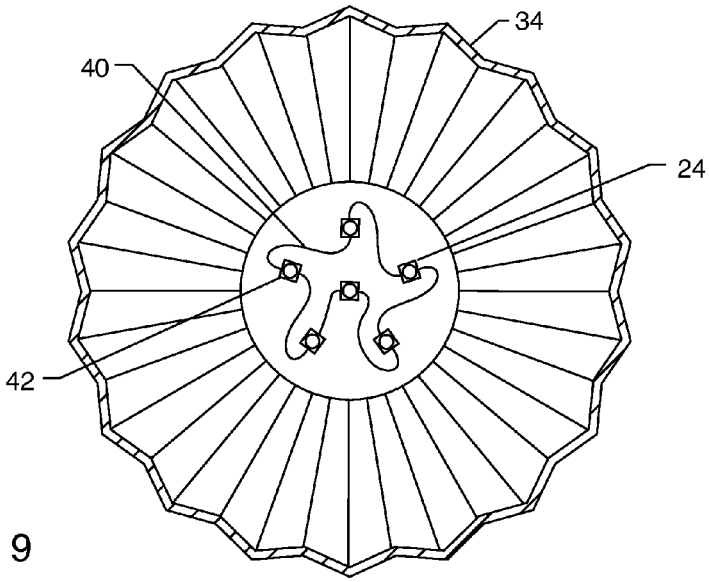
FIG. 9 is a top view of another embodiment of surface interruptions on the inside surface of a conical-shaped housing taken along line 9-9 of FIG. 4.

FIG. 8 is a top view of an embodiment of surface interruptions 34 on the inside surface of the conical-shaped body 18 taken along line 8-8 of FIG. 4. The surface interruptions 34 can comprise a diffuser 34. Here, the surface interruptions/diffuser 34 is rounded. FIG. 9 is a top view of another embodiment of surface interruptions 34 on the inside surface of a conical-shaped body 18 taken along line 9-9 of FIG. 4. Now the surface interruptions 34 are angled. The surface interruptions 34 may be formed form a separate piece attached inside the conical-shaped body 18 or may be formed as part of the conical-shaped body 18 during the press stage of manufacture. The surface interruptions 34 may be formed in a multitude of shapes and sizes by one skilled in the art. Electrical circuit traces 40 are also shown in simplified form. The circuit traces 40 may include LED landings 42 for facilitating the connection to the LEDs 24.

Figure 10:
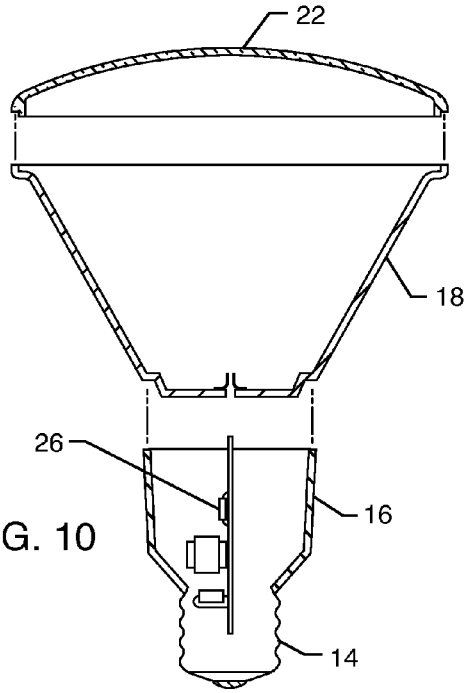
FIG. 10 is an exploded sectional view of another embodiment of the structure of FIG. 1.
Figure 11:
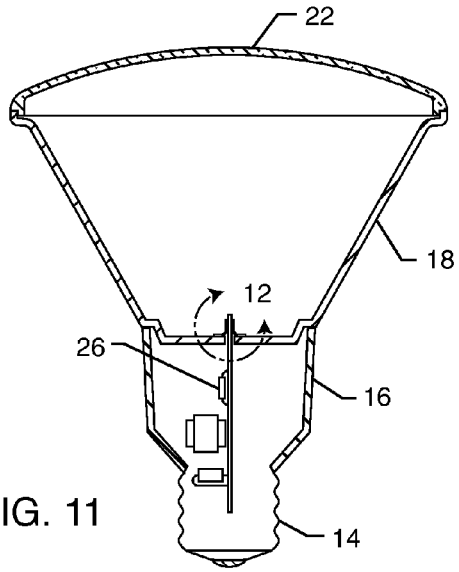
FIG. 11 is an assembled view of the structure of FIG. 10.
Figure 12:
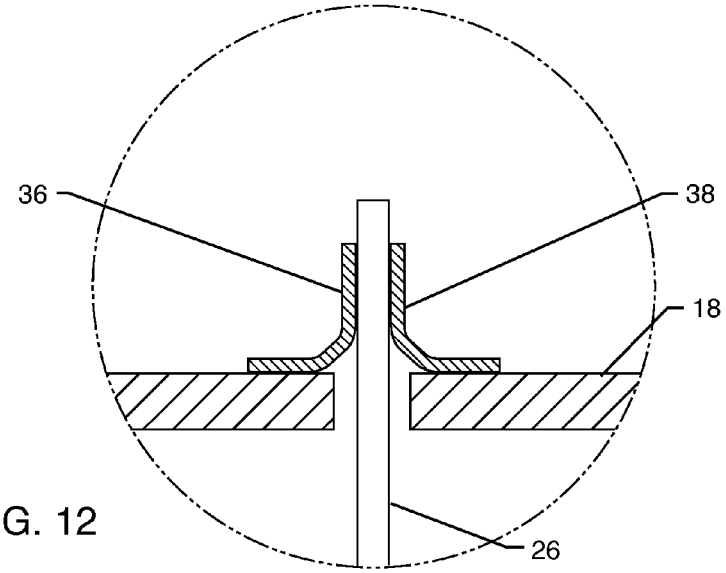
FIG. 12 is an enlarged sectional view of the structure of FIG. 11 taken along line 12-12.

FIG. 10 is an exploded sectional view of another embodiment of the structure of FIG. 1 and FIG. 11 is an assembled view of the structure of FIG. 10. FIG. 12 is an enlarged sectional view of the structure of FIG. 11 taken along line 12-12. In these embodiments, the driver housing 16 has been rotated 90 degrees such that it can fit between and connect the LEDs 24 and the cap 14 without the need for additional electrical connections 28 and 30 shown in the previous embodiments in FIGS. 1-7. Referring now to FIG. 12, the LED driver circuitry 26 electrically connects to the LEDs 24 through a metal contact cathode 36 and a metal contact anode 38. Assembly has now been simplified as all parts can be snapped together in an extremely quick and efficient assembly process.

Another advantage of the design embodied in FIGS. 10-12 is that the AC to DC circuitry 26 can be separated from the rest of the lamp housing 18 and LEDs 24. The lamp housing 18 and LEDs 24 can be manufactured as a stand-alone assembly. Then, the threaded light bulb cap 14, driver housing 16 and LED driver circuitry can also be manufactured as a stand-alone assembly and UL approved just like another AC/DC adapter. The two stand-alone assemblies can then be designed to physically connect or attach to each other and at the same time electrically connect with each other. FIG. 12 shows one embodiment where the LED driver 26 contains a male-type electrical plug and the lamp housing 18 contains a female-type electrical plug. It is to be understood by one skilled in the art that the male and female-type plugs may be reversed. Now, when either portion of the lamp 12 fails, the functioning part may be retained and reused. This lowers the overall cost of maintaining the lamp 10, 12.

For instance, it is likely that the LED driver circuitry 26 will fail before the LEDs 24. A maintenance worker would unscrew the whole lamp 10, 12 from the electrical socket. (These sockets are commonly referred to as Edison-type sockets) Then the maintenance worker would separate the cap 14 and driver housing 16 from the lamp housing 18. A new cap 14 and driver housing 16 can be attached to the older and yet still functioning lamp housing portion 18. Because the LED driver circuitry 26 is cheaper than the LED cluster 24, it is economical to replace only the broken portion. Furthermore, the two assemblies can be sold separately. For instance, a consumer can buy the converter/socket assembly and then choose the type of LED cluster or lamp housing they want to use for their specific space and lighting needs.

Attaching the two stand-alone assemblies can be obtained with fasteners, screw connections, interferences fits, and a range of other methods known to those skilled in the art as this teaching is not limited to a precise form of connection. Furthermore, once the two stand-alone assemblies are attached, additional locking mechanisms may be used to insure the two assemblies do not come apart unexpectedly such as spring loaded locking mechanisms or special release features known to those skilled in the art.

Figure 13:
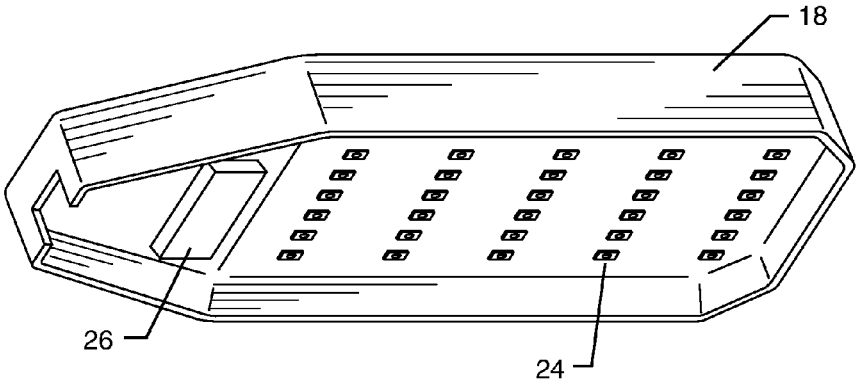
FIG. 13 is a perspective view of another exemplary recessed lamp embodying the present invention.
Figure 14:
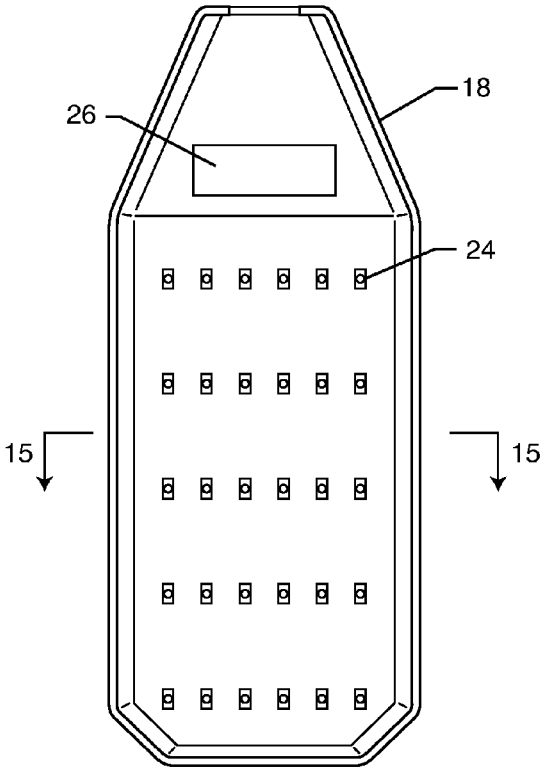
FIG. 14 is a top view of the structure of FIG. 13.
Figure 15:
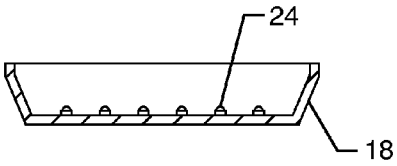
FIG. 15 is a sectional of the structure of FIG. 14 taken along line 15-15.

FIG. 13 is a perspective view of another exemplary recessed lamp 12 embodying the present invention and FIG. 14 is a top view of the structure of FIG. 13. FIG. 15 is a sectional of the structure of FIG. 14 taken along line 15-15. In these embodiments, the ILB 18 has taken an irregular rectangular shape as opposed to a conical shape. These embodiments demonstrate that a series of different shapes may be devised by one skilled in the art through the use of special manufacturing and press tooling. Any shape of a lamp housing 18 can be manufactured according to the present invention and this disclosure is not intended to limit it just to the specific forms shown and described herein.

Although several embodiments have been described in detail for purposes of illustration, various modifications may be made to each without departing from the scope and spirit of the invention. Accordingly, the invention is not to be limited, except as by the appended claims.

What is claimed is:

1. An LED lamp, comprising:

a lamp housing;

an electrical circuit trace disposed on the lamp housing;

an LED attached directly to the lamp housing and electrically connected to the electrical circuit trace;

wherein the lamp housing is in direct thermal conductive relation to the LED such that heat energy is dissipated from the LED directly to the lamp housing; and a first half of an electrical connector attached relative to the lamp housing and electrically connected to the LED, and a second half of the electrical connector attached relative to and electrically connected to LED driver circuitry electrically connected to the electrical circuit trace, wherein the first and second halves of the electrical connector are removably connected.

2. The LED lamp of claim 1, wherein the lamp housing comprises a generally frusto-conical shape.

3. The LED lamp of claim 1, wherein the lamp housing is press formed.

4. The LED lamp of claim 1, including a solder mask affixed over at least a portion of the electrical circuit trace.

5. The LED lamp of claim 1, including a diffuser disposed within the lamp housing.

6. The LED lamp of claim 1, wherein the LED driver circuitry is disposed directly on the lamp housing.

7. The LED lamp of claim 1, wherein the lamp housing comprises an aluminum alloy.

8. The LED lamp of claim 7, where the aluminum alloy is substantially free of silicone.

9. The LED lamp of claim 1 including a housing for the LED driver circuitry.

10. The LED lamp of claim 9, including a threaded incandescent light-type electrical plug configured for reception into a standard incandescent light-type socket.

11. The LED lamp of claim 10, wherein the LED driver circuitry is electrically disposed between the electrical plug and the LED.

12. The LED lamp of claim 1, including a light lens cap attached relative to the lamp housing.

13. The LED lamp of claim 12, including a lens disposed between the light lens cap and lamp housing.

14. The LED lamp of claim 13, wherein the lens comprises a phosphor coating.

15. An LED lamp, comprising:

a lamp housing comprising an aluminum alloy substantially free of silicone;

an electrical circuit trace disposed on the lamp housing;

an LED attached directly to the lamp housing and electrically connected to the electrical circuit trace;

LED driver circuitry electrically connected to the electrical circuit trace; and a housing for the LED driver circuitry;

wherein the lamp housing is in direct thermal conductive relation to the LED such that heat energy is dissipated from the LED directly to the lamp housing; and a first half of an electrical connector attached relative to the lamp housing and electrically connected to the LED, and a second half of the electrical connector attached relative to and electrically connected to the LED driver circuitry, wherein the first and second halves of the electrical connector are removably connected.

16. The LED lamp of claim 15, wherein the lamp housing comprises a generally frusto-conical shape.

17. The LED lamp of claim 15, including a solder mask affixed over at least a portion of the electrical circuit trace.

18. The LED lamp of claim 15, wherein the lamp housing is press formed.

19. The LED lamp of claim 15, including a diffuser disposed within the lamp housing.

20. The LED lamp of claim 15, wherein the LED driver circuitry is disposed directly on the lamp housing.

21. The LED lamp of claim 15, including a threaded incandescent light-type electrical plug configured for reception into a standard incandescent light-type socket.

22. The LED lamp of claim 21, wherein the LED driver circuitry is electrically disposed between the electrical plug and the LED.

23. The LED lamp of claim 15, including a light lens cap attached relative to the lamp housing.

24. The LED lamp of claim 23, including a lens disposed between the light lens cap and lamp housing.

25. The LED lamp of claim 24, wherein the lens comprises a phosphor coating.

* * * * *